United States Patent [19]

Saunion

[11] 4,168,289

[45] Sep. 18, 1979

[54] FLOATLESS CARBURETOR

[76] Inventor: Oscar P. Saunion, 552 E. Alpine, Altamonte Springs, Fla. 32701

[21] Appl. No.: 861,624

[22] Filed: Dec. 19, 1977

[51] Int. Cl.[2] ..... F02M 5/02

[52] U.S. Cl. ..... 261/36 A; 261/72 R; 261/DIG. 50; 220/90.4

[58] Field of Search ..... 261/DIG. 50, 36 A, 72 R; 220/90.4

[56] References Cited

U.S. PATENT DOCUMENTS

| | | | |
|---|---|---|---|
| 2,635,625 | 4/1953 | Moseley et al. | 261/DIG. 50 |
| 2,846,203 | 8/1958 | Voss et al. | 261/DIG. 50 |
| 3,223,392 | 12/1965 | Ball | 261/36 A |
| 3,338,238 | 8/1967 | Warneke | 220/20.5 |
| 3,360,161 | 12/1967 | Smith | 220/90.4 |
| 3,549,044 | 12/1970 | Lerner | 220/90.4 |
| 3,591,073 | 7/1971 | Dennis | 220/20.5 |
| 3,695,590 | 10/1972 | Nishihara | 261/DIG. 50 |
| 3,825,238 | 7/1974 | Ohashi et al. | 261/DIG. 50 |

*Primary Examiner*—Tim R. Miles
*Attorney, Agent, or Firm*—Daniel Jay Tick

[57] ABSTRACT

A baffle device in the fuel bowl of the carburetor of a vehicle maintains the level of fuel in the fuel bowl constant regardless of erratic movement of the vehicle.

5 Claims, 4 Drawing Figures

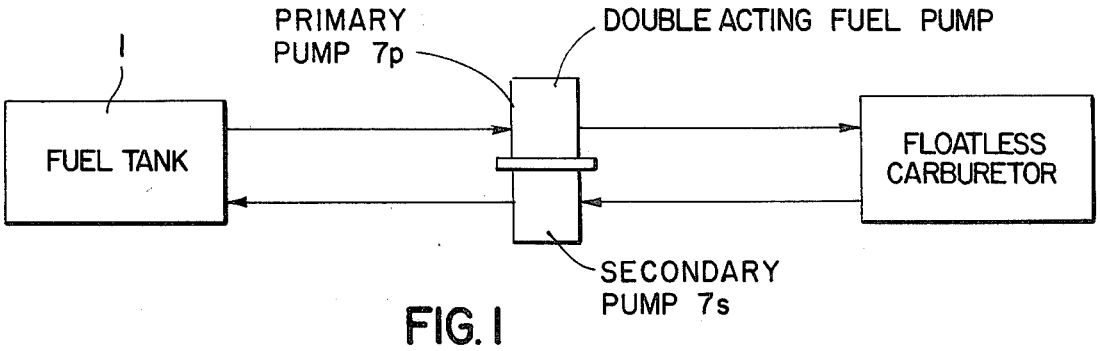
FIG. 1
FIG. 2
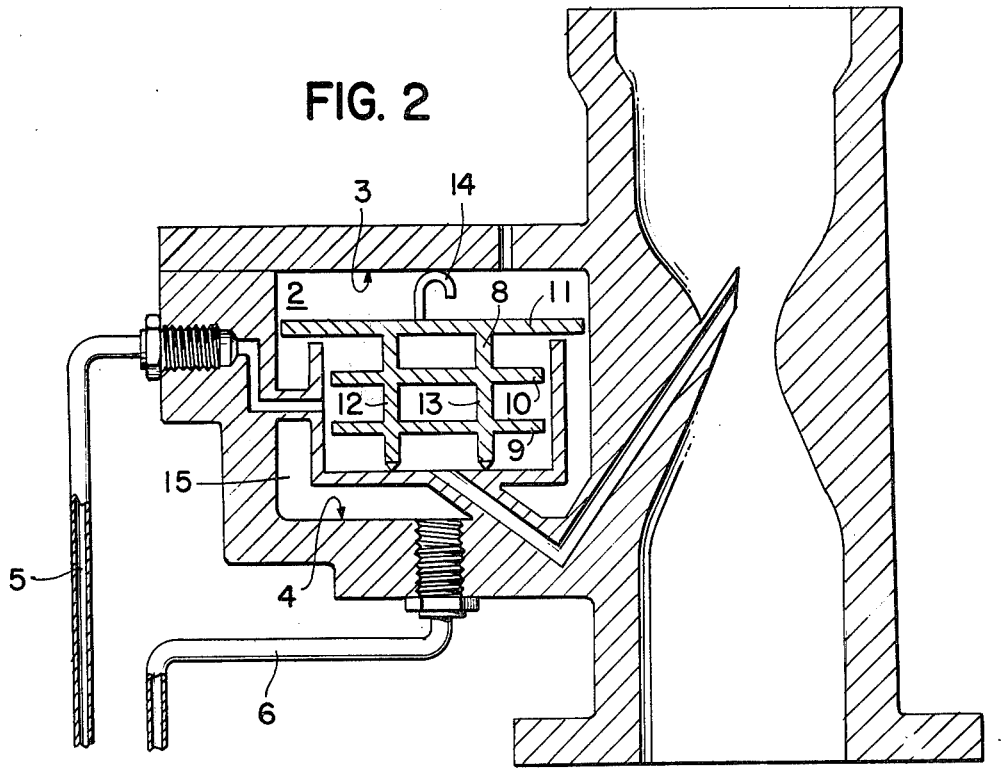

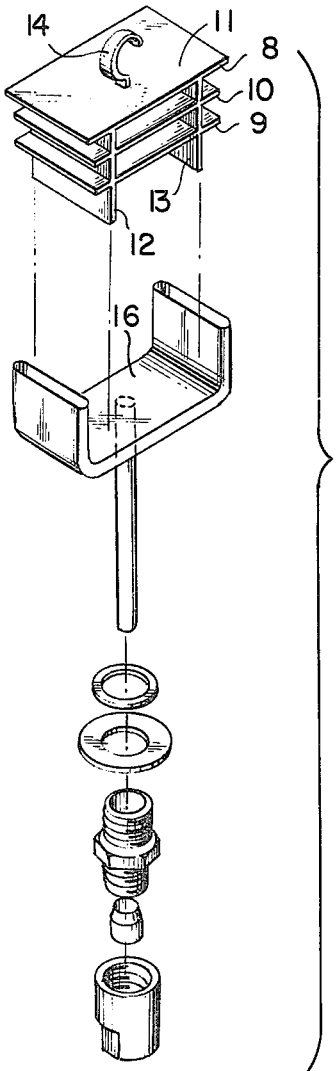
FIG. 3
FIG. 4
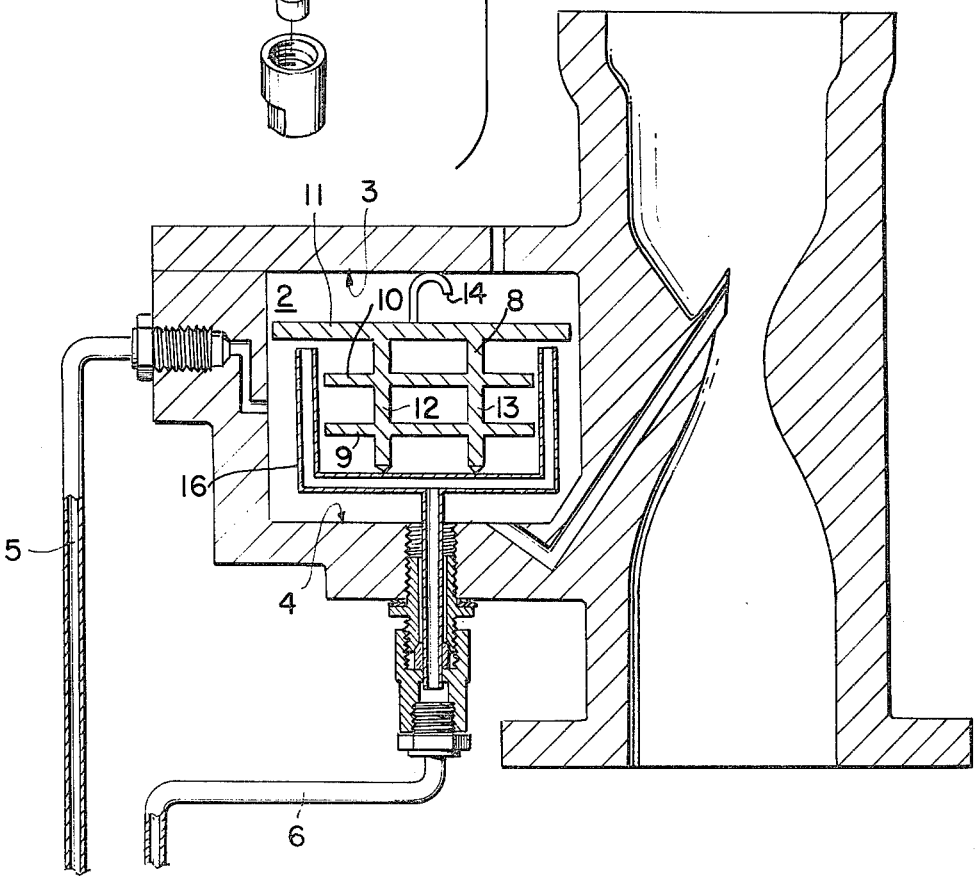

FLOATLESS CARBURETOR

BACKGROUND OF THE INVENTION

The present invention relates to a floatless carburetor. More particularly, the invention relates to a floatless carburetor for a vehicle having a fuel tank, the carburetor having a fuel bowl with spaced opposite substantially parallel top and bottom surfaces, a fuel inlet and a fuel outlet.

There are one barrel carburetors, two and four barrel carburetors. Every carburetor requires a main nozzle per barrel. The fuel bowl of the carburetor assures the level of fuel at the fuel nozzles. A specific fuel bowl level is required in every carburetor for the specific engine with which the carburetor operates. The fuel bowl level assures the level at the main nozzles. The carburetor mixes air with fuel for providing the engine with a properly mixed air/fuel ratio, and for providing the cylinders with fuel required for their operation. The level of fuel at the main nozzles is the most important factor to consider, since it constitutes the base for the formation of the proper air/fuel ratio. If the fuel level in the main nozzles is higher than the specified operating fuel level, the fuel higher than the required level causes the mixture to become richer in fuel. This results in fuel waste and the formation of smoke which eventually is converted into carbon deposits in the combustion chamber and in the exhaust passages.

Waste is caused by movement of the engine with the vehicle as a result of operation of the vehicle. This occurs principally when the brakes are applied, when the vehicle is suddenly turned and/or upon all abrupt or upward or downward movements of the carburetor during the operation of the vehicle. The conventional needle-float carburetor provides a perfect air/fuel ratio only when the engine is almost stationary. The fuel in the main nozzles is at its specified operating fuel level only in this condition. Since the fuel level at the main nozzles is logically assured by the level of fuel in the fuel bowl, which is affected by the movement of the vehicle, the fuel level at the main nozzles is affected too.

Objects of the invention are to provide a floatless carburetor of simple structure, which is inexpensive in manufacture, installed with facility and convenience in new and existing vehicles such as, for example, automotive vehicles of all types, marine vehicles, aircraft, and the like, and functions efficiently, effectively and reliably to considerably increase mileage attained with an internal combustion engine per gallon of fuel, eliminate overspilling, eliminate vapor lock, eliminate pollution of the atmosphere due to overrichness of fuel, eliminate heat off, eliminate fouling of spark plugs, provide longer lasting engine tuneups and greatly reduce the atmospheric pressure problem of the carburetor air to fuel ratio at high altitudes.

Regardless of horizontal or vertical movements of the carburetor during operation of the vehicle, the fuel bowl level is always maintained constant.

The carburetor of the invention eliminates the needle-float assembly and provides a fuel bowl of the same height as the specified operating fuel level at the main nozzles, continually assuring the specified operating fuel level at all times, regardless of the movement of the engine. The carburetor of the invention thus maintains the fuel level steady, invariable, unchanging or constant. This is due to the constant filling of the fuel bowl by the primary pump outlet and the control, by the baffle unit 8, of the flow restriction of fuel flowing between the partitions of the baffle unit during erratic movement of the vehicle. The carburetor of the invention controls the steadiness of the fuel level by controlling the upward and downward fluctuations of the fuel level. The baffle unit partitions deaden the input fuel pump residual primary pump pressure and distribute the fuel in the fuel bowl. The baffle unit controls the flow of fuel in the fuel bowl, since this is the only way to maintain the specified operating fuel level at the main nozzles carburetor venturi area. The more the vehicle moves, the steadier or more constant the fuel level at the main nozzles remains, thereby eliminating waste and smoke. This results in fuel economy and less ambient contamination or air pollution due to smoke generated. Conventional carburetors are different, since they do not overcome this condition.

BRIEF SUMMARY OF THE INVENTION

In accordance with the invention, a floatless carburetor for a vehicle having a fuel tank, said carburetor having a fuel bowl with spaced opposite substantially parallel top and bottom surfaces, fuel inlet means and fuel outlet means, said carburetor being coupled to the fuel tank via a double acting fuel pump, comprises a baffle unit in the fuel bowl for maintaining the level of fuel in the fuel bowl constant regardless of erratic movement of the vehicle. The baffle unit comprises a plurality of baffle plates in spaced substantially parallel relation to the top and bottom of the fuel bowl and baffle plates in spaced substantially parallel relation substantially perpendicular to the plurality of baffle plates. The baffle plates and the plurality of baffle plates are affixed to each other to form an integral structure.

The plurality of baffle plates include an uppermost plate closest to the top of the fuel bowl. A spring extends from the uppermost plate and abuts the top of the fuel bowl for maintaining the baffle unit in position.

BRIEF DESCRIPTION OF THE DRAWINGS

In order that the invention may be readily carried into effect, it will now be described with reference to the accompanying drawings, wherein:

FIG. 1 is a block diagram illustrating the positioning of the floatless carburetor of the invention in an internal combustion engine system;

FIG. 2 is a view, on an enlarged scale, partly cut away and partly in section, of an embodiment of the floatless carburetor of the invention;

FIG. 3 is an exploded perspective view of the baffle device of the floatless carburetor of the invention; and FIG. 4 is a view, on an enlarged scale, partly cut away and partly in section, of a conventional carburetor, converted to the floatless carburetor of the invention with the components of FIG. 3 added.

DETAILED DESCRIPTION OF THE INVENTION

In order to maintain the fuel level constant, known carburetors utilize float and needle arrangements. The floatless carburetor of the invention utilizes a baffle device to maintain the fuel level in the carburetor constant.

The floatless carburetor of the invention is for a vehicle such as, for example, any type of motor vehicle, marine craft, aircraft, or the like, having an internal combustion engine or similar type of engine utilizing liquid fuel mixed with air and a fuel tank 1 (FIG. 1).

The carburetor of the invention has a fuel bowl 2 (FIGS. 2 and 4) with spaced opposite substantially parallel top and bottom surfaces 3 and 4, respectively (FIGS. 2 and 4). The carburetor also has a fuel inlet 5 and a fuel outlet 6 (FIGS. 2 and 4).

The carburetor of the invention is coupled to the fuel tank 1 of the vehicle in which it is installed via a double acting fuel pump, as shown in FIG. 1. The fuel pump includes a primary pump *7p* and a secondary pump *7s*.

The carburetor of the invention comprises a baffle device 8 (FIGS. 2 to 4) in the fuel bowl 2 for maintaining the level of fuel in the fuel bowl constant, regardless of erratic movement of the vehicle. The word "constant" is intended to mean steady, invariable or unchanging, in accordance with its dictionary definition.

The baffle device 8 comprises, as shown in the FIGS., a plurality of baffle plates 9, 10 and 11 in spaced substantially parallel relation to the top and bottom 3 and 4, respectively, of the fuel bowl. The plurality of baffle plates 9, 10 and 11 includes the uppermost plate 11 closest to the top 3 of the fuel bowl 2.

The baffle device 8 further comprises a pair of baffle plates 12 and 13 in spaced substantially parallel relation substantially perpendicular to the plurality of baffle plates 9, 10 and 11. The baffle plates 9 to 13 are preferably affixed to each other to form an integral structure.

A substantially C-type spring 14 of resilient steel, or the like, (FIGS. 2 to 4) extends from the uppermost plate 11 of the baffle device 8 and abuts the top 3 of the fuel bowl 2 to maintain said baffle device in position.

The fuel bowl 2 of FIG. 2 has the same depth or height as the specified operating fuel level required by the specific type of engine with which the carburetor operates. Since the fuel bowl 2 is not connected to an outer bowl passage 15, fuel will not flow into said outer passage until said fuel bowl is completely full. In the embodiments of FIGS. 2 and 4, the partitions of the baffle unit 8 facing the fuel input in FIG. 2 deaden the residual pressure of fuel entering the fuel bowl 2 and distribute the fuel.

The primary fuel pump *7p* feeds the carburetor through the fuel inlet line 5 (FIGS. 2 and 4). The secondary fuel pump *7s* draws fuel from the outer bowl passage 15 of FIG. 2 and pumps it through the fuel outlet line 6 to the fuel tank. The secondary fuel pump *7s* also draws fuel from an outlet unit 16 of FIG. 4 and pumps it through the fuel outlet line 6 to the fuel tank 1.

The embodiment of FIG. 2 starts when the engine switch is turned ON. The primary pump *7p* draws gasoline from the fuel tank 1 and pumps it to the carburetor. Fuel flows through the fuel inlet line 5 to the carburetor. Fuel flows through the carburetor inlet passage. The fuel flow to the carburetor is evaluated, considered and calibrated by the manufacturer of the carburetor to conform to the specific type of engine with which the carburetor operates. Fuel entering the fuel bowl 2 flows into the baffle partition facing the inlet of said fuel bowl. The partition receives the fuel input, decreases the residual primary pump pressure and distributes the fuel.

The fuel flow is distributed under the control or restriction of the baffle unit 8, since said baffle unit controls the internal flow of fuel in the fuel bowl 2. During filling of the fuel bowl 2, any fuel pressure around the nozzle jet and fuel turbulence in said bowl is eliminated by the baffle unit 8. The atmospheric pressure, gravity force and continuous suction power of the secondary pump *7s* balances the fuel level of the main nozzles in completely normal condition. This is the key to the carburetor of the invention. If the baffle unit 8 is removed, it is completely impossible to control the residual pressure or fuel level in the fuel bowl 2, since there is agitation or turbulence of the fuel, making the very important specified operating fuel level control of the main nozzles impossible. The baffle unit 8 thus maintains a constant, steady or invariable fuel level in the fuel bowl 2 by controlling the internal fuel flow restriction of fuel between the partitions of the baffle unit 8 during erratic movement of the vehicle.

The primary pump *7p* completely fills the fuel bowl 2 and maintains the fuel level in said fuel bowl due to constant fuel flow input. Since the fuel bowl 2 is not connected to the outer bowl passage 15 until it is completely full, fuel will not continue flowing into the outer bowl passage 15. Fuel flows over the top of the fuel bowl 2, or overflows said fuel bowl, and flows into the outer bowl passage 15 by the force of gravity and by the suction power of the secondary pump *7s* inlet power through the fuel outlet line 6. The primary pump *7p* outlet constantly fills the fuel bowl 2. Fuel continues to flow down into the outer bowl passage 15, reaching the bottom surface 4 and continuing the flow through the carburetor fuel outlet line 6, drawn by the suction power of the secondary pump *7s* inlet and assisted by the force of gravity. Fuel is pumped by the secondary pump *7s* outlet into the fuel tank 1. As long as the engine continues operating, the aforedescribed steps are repeated, until the engine is turned off. Research tests demonstrate that the outer bowl passage 15 functions primarily as a fuel passage, regardless of its large fuel capacity, since the primary fuel flow is restricted and the engine fuel requirements free the secondary pump *7s* to operate without any restriction on fuel flow.

During engine operation, the constant suction power of the primary pump *7p* inlet draws fuel from the fuel tank 1 and the constant pumping power of the primary pump *7p* outlet pumps fuel to the carburetor of FIG. 2 through the fuel inlet line 5 and through the carburetor inlet. The primary pump *7p* constantly fills the fuel bowl 2, and the baffle unit 8 controls the internal flow restriction of fuel flowing between the partitions of said baffle unit during erratic movement of the vehicle. The fuel overflowing the fuel bowl 2 into the outer bowl passage 15 constitutes the constant specified operating fuel level. The outer bowl passage 15 is always under the constant suction power of the secondary pump *7s* inlet, so that said secondary pump inlet constantly draws fuel from said outer bowl passage. Fuel continues to flow downward to the bottom surface 4 of the fuel bowl 2 and through the fuel outlet line 6. The fuel flows freely and constantly under the suction power of the secondary pump *7s* and is then pumped to the fuel tank 1 under the pumping power of said pump.

When the vehicle moves erratically, such as during abrupt brake applications, abrupt turns, and upward and downward movement, the baffle unit 8 of the invention prevents the tendency of the fuel in the fuel bowl 2 to overflow said bowl and thereby prevents raising of the level of fuel at the main nozzles, so that it prevents resultant waste of fuel and air pollution.

The embodiment of FIG. 4 starts when the engine switch is turned ON. The primary pump *7p* inlet draws gasoline from the fuel tank 1 and pumps it to the carburetor. The secondary pump *7s* inlet draws gasoline from the outlet unit 15, which is initially empty. The suction power of the pump assists the overall operation of the carburetor, neutralizing the residual pressure of the primary pump *7p*. Fuel flows to the carburetor of FIG. 4 through the fuel inlet line 5, and through the carburetor inlet passage.

When a conventional carburetor is converted to the carburetor of FIG. 4, the needle seat body remains installed during the conversion. Only the needle and the float are removed from the conventional carburetor and are replaced by the components of FIG. 3.

The fuel flow is distributed by the baffle unit 8, since the partitions of said baffle unit control the internal flow of fuel in the fuel bowl 2. During the filling of the fuel bowl 2, any fuel pressure around the nozzle jet and any fuel turbulence in said fuel bowl is eliminated. The atmospheric pressure, gravity force and continuous suction power of secondary pump *7s* balances the fuel level of the main nozzles in a completely normal condition. This is the key to the carburetor of the invention. If the baffle unit 8 is removed, it is impossible to control the residual pump pressure of the fuel level in the fuel bowl 2, since the fuel is agitated and becomes turbulent, making the very important main nozzle specified operating fuel level control impossible. The integral partitions of the baffle unit 8 maintain the fuel level in the fuel bowl 2. This is due to the constant filling of the fuel bowl 2 by the primary pump *7p* up to the top of the outlet unit 16 and the internal flow restriction of fuel flowing between the partitions of the baffle unit 8.

The primary pump *7p* outlet constantly fills the fuel bowl 2 up to the top of the outlet unit 16. Fuel flows over the top of the outlet unit 16 and flows down into said outlet unit by gravity force and by the suction power of the secondary pump *7s* through the fuel outlet line 6. Fuel continues to flow down through the outlet unit 16 and through the fuel outlet lines 6 of the carburetor, drawn by the suction power of the secondary pump *7s*. Fuel is pumped by the secondary pump *7s* into the fuel tank 1. As long as the engine continues operating, the aforedescribed steps are repeated, until the engine is turned OFF.

During the operation of the engine, the constant suction power of the primary pump *7p* inlet draws fuel from the fuel tank 1. The constant pumping power of the primary pump *7p* outlet pumps fuel to the carburetor of FIG. 4 through the fuel inlet line 5 and through the carburetor inlet. The carburetor of FIG. 4 is a conventional one, converted to the invention by the inclusion of the components of FIG. 3, after minor machining. During the conversion of the conventional carburetor to the carburetor of the invention, only the needle and float are removed. The outlet unit 16 is positioned at the specified operating fuel level prescribed for the specific carburetor. The primary pump *7p* outlet constantly fills the fuel bowl 2 up to the top of the outlet unit 16 and the partitions of the baffle unit 8 restrict the internal flow of fuel therebetween during erratic movements of the vehicle. The fuel overflowing the top of the outlet unit 16 is the constant specified operating fuel level. The outlet unit 16, which is a fuel outlet, is under the constant suction power of the secondary pump *7s* inlet. The secondary pump *7s* inlet suction power draws fuel from the outlet unit 16 and the fuel continues to flow down, assisted by the force of gravity, inside said outlet unit, under the constant suction power of said secondary pump inlet. The fuel continues to flow out of the carburetor outlet of FIG. 4 through the fuel outlet line 6. The secondary pump *7s* outlet then pumps the fuel to the fuel tank 1.

While the invention has been described by means of a specific example and in a specific embodiment, I do not wish to be limited thereto, for obvious modifications will occur to those skilled in the art without departing from the spirit and scope of the invention.

I claim:

1. A floatless carburetor for a vehicle having a fuel tank, said carburetor having a fuel bowl with spaced opposite substantially parallel top and bottom surfaces, fuel inlet means and fuel outlet means, said carburetor comprising baffle means in the fuel bowl for maintaining the level of fuel in the fuel bowl steady regardless of erratic movement of the vehicle, said baffle means comprising a plurality of baffle plates in spaced substantially parallel relation to the top and bottom of the fuel bowl and baffle plates in spaced substantially parallel relation substantially perpendicular to the plurality of baffle plates, said baffle plates and said plurality of baffle plates being affixed to each other to form an integral structure; and a double acting fuel pump coupling said carburetor to the fuel tank.

2. A floatless carburetor as claimed in claim 1, wherein said plurality of baffle plates includes an uppermost plate closest to the top of the fuel bowl, and further comprising spring means extending from the uppermost plate and abutting the top of the fuel bowl for maintaining said baffle means in position.

3. A floatless carburetor as claimed in claim 1, wherein said vehicle has an engine, and further comprising main fuel nozzles extending from said carburetor to the engine of the vehicle, and wherein said pump constantly fills said fuel bowl with fuel and the maintaining of a steady level of fuel in said fuel bowl by said baffle means results in a steady level at the main nozzles.

4. A floatless carburetor as claimed in claim 3, wherein said fuel bowl has a bottom and sides extending from the bottom to a height from said bottom corresponding to the specified operating fuel level whereby the steady level maintained at said main nozzles is the specified operating fuel level.

5. A floatless carburetor as claimed in claim 4, further comprising an outlet unit surrounding said fuel bowl and extending to the specified operating fuel level whereby fuel filling said fuel bowl overflows into the outlet unit thereby maintaining a steady level of fuel in said fuel bowl.

* * * * *